US006339847B1

(12) United States Patent
Hanks

(10) Patent No.: US 6,339,847 B1
(45) Date of Patent: Jan. 22, 2002

(54) ONE PIECE GARMENT WITH BOOT PORTIONS OF ADJUSTABLE SIZE

(76) Inventor: Charlene C. Hanks, 3132 Holland Dr., Orlando, FL (US) 32825

( * ) Notice: Subject to any disclaimer, the term of this patent is extended or adjusted under 35 U.S.C. 154(b) by 0 days.

(21) Appl. No.: 09/435,231

(22) Filed: Nov. 5, 1999

(51) Int. Cl.[7] ..... A41D 27/10
(52) U.S. Cl. ..... 2/269; 2/80
(58) Field of Search ..... 2/69.5, 75, 80, 2/111, 402, 408, 269, 270, 920

(56) References Cited

U.S. PATENT DOCUMENTS

| | | | | | |
|---|---|---|---|---|---|
| 2,563,161 | A | * | 8/1951 | Dixon | 2/80 |
| 2,588,542 | A | * | 3/1952 | Kunz | 2/80 |
| 2,598,462 | A | * | 5/1952 | Strauss | 2/69.5 |
| 2,680,849 | A | * | 6/1954 | Munro | 2/69.5 |
| 2,705,326 | A | * | 4/1955 | Lahnstein et al. | 2/83 |
| 2,705,804 | A | * | 4/1955 | Walker | 2/83 |
| 2,730,723 | A | * | 1/1956 | Jonsson | 2/270 |
| 2,738,512 | A | * | 3/1956 | Winer | 2/80 |
| 2,814,044 | A | * | 11/1957 | Tucker | 2/80 |
| 2,905,944 | A | * | 9/1959 | Stuart et al. | 2/83 |
| 2,994,089 | A | * | 8/1961 | Ferguson, Jr. et al. | 2/81 |
| 3,381,311 | A | * | 5/1968 | Wormser | 2/270 |
| 3,555,567 | A | * | 1/1971 | Owen | 2/69.5 |
| 3,653,074 | A | * | 4/1972 | Nobile et al. | 2/80 |
| 4,825,475 | A | * | 5/1989 | Smart | 2/312 |
| 5,170,505 | A | * | 12/1992 | Rohrer | 2/69 |
| D359,843 | S | * | 7/1995 | Jones | D2/980 |
| 5,504,944 | A | * | 4/1996 | Bromer et al. | 2/269 |

OTHER PUBLICATIONS

Gershman, Maurice: Journal of the American Medical Asso.:vol. 168, No. 7 p. 930, Oct. 1958.*

* cited by examiner

*Primary Examiner*—Amy Vanatta
*Assistant Examiner*—Alissa L. Hoey
(74) *Attorney, Agent, or Firm*—Frank L. Kubler

(57) ABSTRACT

A garment includes a pants portion having a waist region and two pant legs, each of the pant legs including a leg connected end joined to the waist region and a leg free end having an end wall which closes the leg free end, so that the waist region and two pant legs are unified as a single piece garment; and a pant leg tying element secured around each of the pant legs for contracting the given pant leg around and against a wearer leg contained within the pant leg to grip the wearer leg, preferably at the wearer ankle, and thereby to define a garment boot portion at the leg free end matching the size of the given wearer foot and preventing relative movement of the given wearer foot within the given leg free end.

1 Claim, 3 Drawing Sheets

ONE PIECE GARMENT WITH BOOT PORTIONS OF ADJUSTABLE SIZE

BACKGROUND OF THE INVENTION

1. Field of the Invention

The present invention relates generally to the field of garments and particularly to children's garments. More specifically the present invention relates to a garment including a blouse or shirt portion and a pants portion having pant legs which are closed at their free ends with end walls to define integral boot portions. A draw string is provided around the outer surface of each pant leg at or above the wearer ankle to define the size of the garment boot portion. The end wall is pulled against or placed in close proximity with the end of the wearer feet and the draw strings are drawn snugly around the pant leg, gripping and anchoring the pant leg against the wearer leg, preferably at the wearer ankle. Then the free ends of each draw string are tied or otherwise secured together. A key inventive feature of the present invention is that, should the feet of a garment wearer such as a child grow, or should another person of a different foot size use the garment, the boot portion size is automatically defined at that very foot size because the foot fills exactly the length of pant leg corresponding the length of the given foot, and the draw string is once again tied to secure with friction the pant leg to the wearer leg, again preferably at the wearer ankle, so that the wearer foot does not slide in and out of the pant leg free end during walking. Where the size of the wearer foot placed into the garment increases, part of the pant leg length becomes part of the boot portion length as needed to make the boot portion just that much larger for a perfect fit. Where the size of the foot placed in the garment decreases, part of the boot portion length becomes part of the pant leg length to make the boot portion just that much smaller, once again for a perfect fit. In either instance, the draw string then is tied to fix and define the new boot portion size.

2. Description of the Prior Art

There have long been matching garment sets including separate shirts, pants and booties. Examples of such sets are the DAY 'N NITEES™ manufactured by STAYON PRODUCTS, INC.™, where the booties have tie strings. A problem with this prior garment set is that the booties are separate, so that when they are tied around the wearer ankles they always define booties of the same one size. Other examples are those of the TODDLETIME™ Terry Stretch-All Sleepers and the BRIGHT FUTURE™ Footed Terry Stretch-all, in which the booties are a unified part of the pants, and the pants are separate from the shirt. A problem with these garments is that no tying means are provided near the boot portions to define the boot portions at any given size. As a result, unless the wearer leg and foot just match the length of the leg and bootie combination, the foot either presses uncomfortably against the closed end of the bootie or the foot slides within the pant leg toward and away from the bootie closed end.

It is thus an object of the present invention to provide a garment having pants with a unified boot portion which is of adjustable size to accommodate some growth of a child or the size difference another wearer.

It is another object of the present invention to provide such a garment in which the boot portions are secured to the wearer ankles with tying means, to define boot portions of a size matching the wearer foot size and so that the wearer foot does not slide in and out of the boot portions.

It is still another object of the present invention to provide such a garment which also includes a unified shirt portion.

It is finally an object of the present invention to provide such a garment which can be manufactured at a price which is competitive with those of other garments sold for similar purposes.

SUMMARY OF THE INVENTION

The present invention accomplishes the above-stated objectives, as well as others, as may be determined by a fair reading and interpretation of the entire specification.

A garment is provided including a pants portion having a waist region and two pant legs, each of the pant legs including a leg connected end joined to the waist region and a leg free end having an end wall which closes the leg free end, so that the waist region and two pant legs are unified as a single piece garment; and a pant leg tying element secured around each of the pant legs for contracting the given pant leg around and against a wearer leg contained within the pant leg to grip the wearer leg, preferably at the ankle, and thereby to define a garment boot portion at the leg free end matching the size of the given wearer foot and preventing relative movement of the given wearer foot within the given leg free end.

The pant leg tying elements preferably include a cord wrapped around each leg free end. The cord is preferably a draw string contained within a circumferential pant leg pocket, the cord having draw string free ends extending out of the circumferential pant leg pocket for pulling the pant leg material snugly around the wearer leg, preferably at the ankle, and for tying together to releasibly secure the pant leg relative to the wearer leg.

The garment preferably additionally includes a shirt portion joined to the pants portion so that the shirt portion and the pants portion together form a unified one-piece garment. The shirt portion preferably includes a collar and an upright wearer entry slit extending downwardly from the collar, the slit being fitted with a releasible slit fastener for closing the wearer entry slit. The wearer entry slit optionally is divided into two leg slits, each of the leg slits extending longitudinally along one of the pant legs and being fitted with the releasible slit fastener. Each of the tying elements preferably is positioned along the corresponding pant leg to grip the wearer leg in the vicinity of the wearer ankle.

BRIEF DESCRIPTION OF THE DRAWINGS

Various other objects, advantages, and features of the invention will become apparent to those skilled in the art from the following discussion taken in conjunction with the following drawings, in which.

DETAILED DESCRIPTION OF THE PREFERRED EMBODIMENTS

Figure 1:
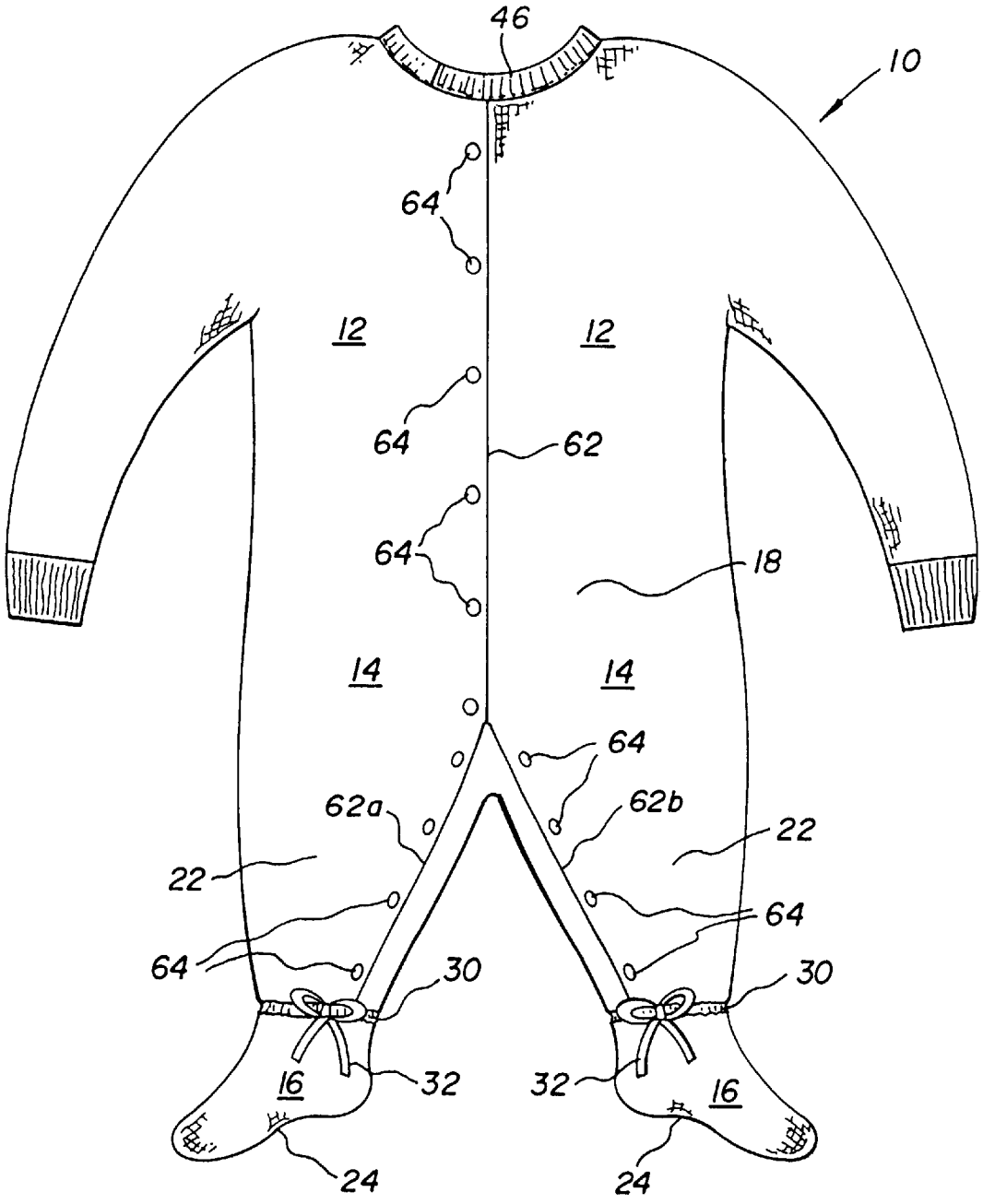
FIG. 1 is a front view of the preferred garment, having the optional leg slits.
Figure 2:
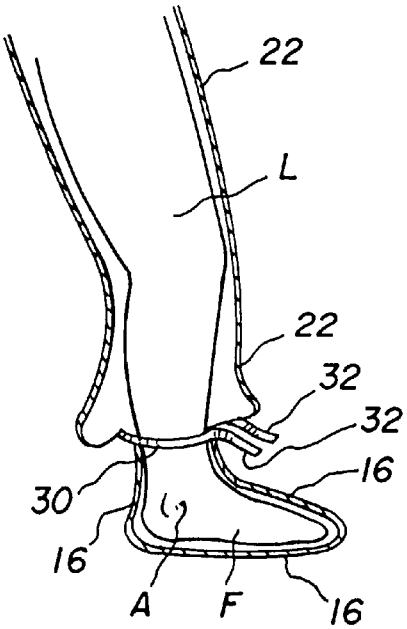
FIG. 2 is a side view of a wearer leg fitted with one of the garment pant legs, boot portion and tying element, showing the wearer leg in broken lines and slack pant leg material immediately above the tying element.
Figure 3:
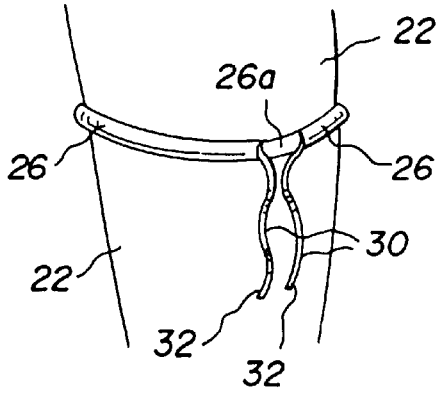
FIG. 3 is a close-up broken away view of a pant leg free end having the circumferential pocket and draw string tying element.
Figure 4:
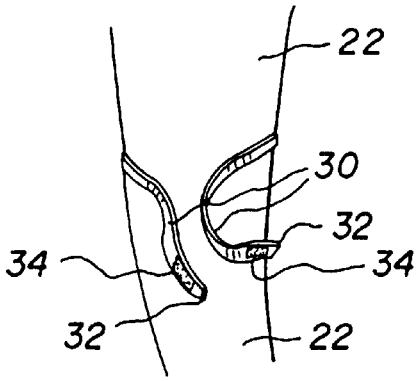
FIG. 4 is a close-up broken away view of a pant leg free end showing a tying element in the form of a ribbon of fabric having hook and loop fasteners on their free ends, as an alternative to tying the draw string free ends.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various FIGURES are designated by the same reference numerals.

First Preferred Embodiment

Referring to FIGS. 1–4, a garment 10 is disclosed including a blouse or shirt portion 12 and a pants portion 14 having a waist region 18 and having pant legs 22. Each pant leg 22 is closed at its free end by a leg end wall 24. A tying element 30 such as a cord in the form of a draw string is provided around the outer surface of each pant leg 22 at or above the wearer ankle. The leg end wall 24 is pulled against or into close proximity with the end of the wearer foot F and secured in that positional relationship by drawing tying element 30 snugly around the pant leg 22, gripping and thereby anchoring the pant leg 22 against the wearer leg L, preferably at the wearer ankle. Tying element 30 is drawn sufficiently tight to create enough friction to prevent relative movement between the pant leg 22 and the wearer leg L contained within it. Then tying element 30 is tied or otherwise secured at that location to define the size of a boot portion 16 of garment 10. See FIG. 2. The pants portion 14 and boot portion 16, and preferably a shirt portion 12 if provided, are thus a unified one-piece fabric garment 10.

A key inventive feature of the present invention is that, should the feet of a wearer such as those of a child grow larger over time, or should another person having a different foot size use garment 10, the boot portion 16 size is automatically defined at the very size of the particular wearer foot F, or wearer foot F and ankle A. This is because the wearer foot F and ankle A fill exactly the length of pant leg 22 corresponding the length of the given wearer foot F and ankle A, and the tying element 30 is once again tied to secure the pant leg 22 relative to the wearer leg L so that the wearer foot F does not slide within the leg portion 22 free end during walking.

Figure 5:
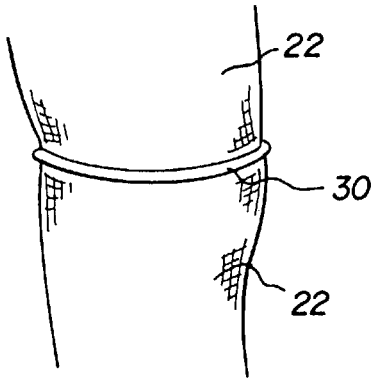
FIG. 5 is a view as in FIG. 4 showing the elastic or rubber band embodiment of the tying element.

In other words, where the size of the wearer foot F placed into the garment 10 increases, part of the pant leg 22 length becomes part of the boot portion 16 length as needed to make the boot portion 16 a perfect fit, and where the size of the foot placed in the garment 10 decreases, part of the boot portion 16 length becomes part of the pant leg 22 length, and then is tied to fix and define the new boot portion 16 size. The pant legs 22 preferably are of sufficient length relative to the rest of garment 10 that they can give up a portion of their length to add to the length or depth of the boot portions 16 without pulling taut and without lowering the garment 10 waist region. As a result, there is some slack in pant legs 22 above tying element 30 when the wearer is at the smaller end of the garment 10 size range.

Where tying element 30 is a draw string, or a continuous loop elastic band as in FIG. 5, tying element 30 may be separate from the pant leg 22 to which it is secured, or sewn to the outer surface of each pant leg 22 near the closed end. Still alternatively, tying element 30 may extend within a circumferential pant leg pocket 26 in the pant leg 22 with tying element free ends 32 extending out of a pocket opening 26*a* to draw and gather the pant leg 22. See FIG. 3. Tying element 30 may be snugly and yet removably secured around the pant leg 22 and wearer leg L by tying its tying element free ends 32 together. Alternatively, tying element 30 may take the form of a strap or ribbon having hook and loop fasteners 34 along its tying element free ends 32 which are engagingly and removably meshed together. See FIG. 4.

Figure 6:
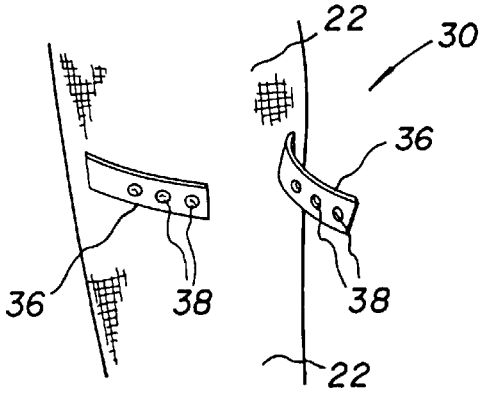
FIG. 6 is a view as in FIG. 4 showing the double tab embodiment of the tying element having tab fasteners in the form of snap fastener halves.
Figure 7:
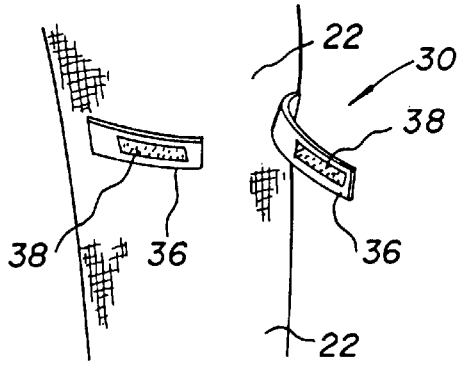
FIG. 7 is a view as in FIG. 4 showing the double tab embodiment of the tying element having tab fasteners in the form of hook and loop fastener strips.
Figure 8:
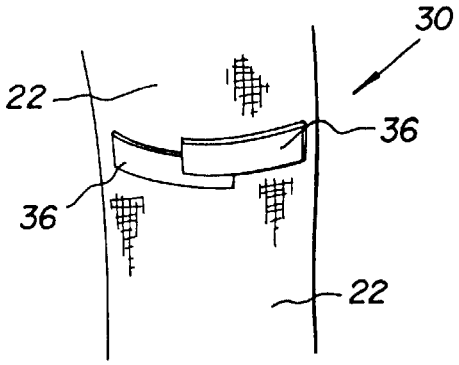
FIG. 8 is a view as in FIG. 4 showing the pant leg pulled tight around the wearer leg at the ankle and the tabs of either FIG. 6 or FIG. 7 overlapped and the tab fasteners engaged.

Still alternatively, tying element 30 may be a pair of flexible tabs 36. Each tab 36 is sewn or otherwise secured at a tab 36 first end to the pant leg 22, while tab 36 second ends remain free and pivotable away from pant leg 22. The tab 36 first ends are preferably secured to opposing sides of the pant leg 22 and tab 36 second ends are fitted with tab fasteners 38 for joining the tabs 36 together. Tab fasteners 38 may be mating hook and loop fastener patches or strips as shown in FIG. 7, or may be opposing and mating portions of snap fasteners, as shown in FIG. 6. The tab 36 second ends are both pulled perpendicular to the wearer leg and in the same direction by the wearer to draw the opposing side of the pant leg 22 taut, and while maintaining tension in tabs 36, tabs 36 are placed face to face so that the fasteners engage and hold the pant leg 22 drawn tightly around the wearer leg. Elongate hook and loop fasteners 38 and alternatively a series of snap fastener halves permit securing of tabs 36 at any of several overlap positions to draw the pant leg 22 tight around wearer legs L of different circumferences.

Figure 9:
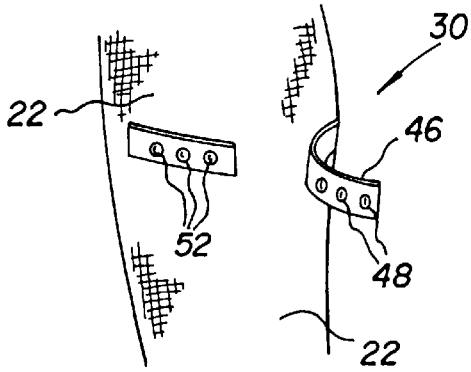
FIG. 9 is a view as in FIG. 4 showing the single tab and pant leg fastener embodiment of the tying element.

A single tab 46 might be used instead, having the secured tab first end and free tab second end fitted with a tab fastener 48. A pant leg fastener 52 is secured to the pant leg 22 at a location spaced apart from the tab 46 about the pant leg 22 circumference. See FIG. 9. The single tab 46 second end and the pant leg fastener 52 are pulled toward each other, drawing the pant leg 22 tight around the wearer leg, and then the single tab fastener 48 and pant leg fastener 52 are brought together and into engagement. Elongate hook and loop tab and pant leg fasteners 48 and 52, respectively, and alternatively a series of snap fastener halves for tab and pant leg fasteners 48 and 52, respectively, permit securing of single tab 46 at any of several circumferential positions on pant leg fastener 52, to draw the pant leg 22 tight around wearer legs L of different circumferences.

A wearer entry slit 62 fitted with zipper or button slit fasteners 64 is preferably provided in the front or rear of the shirt portion 12 and extends from the collar 66 down to the crotch area of the pants portion 14, for access in putting on and taking off the garment 10. The slit 62 optionally divides into two wearer entry slits 62*a* and 62*b* at the crotch area and extends down each pant leg 22. See FIG. 1. The garment 10 would typically, although not necessarily, be child sleeping wear, and made of the same soft and elastic sleeping garment materials used to make existing pajamas.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim as my invention:

1. A garment consisting of:

a pants portion having a waist region and two pant legs, each of said pant legs comprising a leg connected end joined to said waist region and a leg free end having an end wall which closes said leg free end, such that said waist region and said two pant legs are unified as a single piece garment;

and pant tying means for each of legs extending circumferentially around each pant leg for contracting the pant leg around and against a wearer leg contained within the pant leg to grip the wearer leg, said pant leg tying means being separate from the pant leg for relative movement toward and away from said leg free end prior to contracting the pant leg to define a garment boot portion at the leg free end matching the size of the foot and substantially limiting relative movement of the foot within the leg free end.

* * * * *